US005942710A

United States Patent [19]

Hayakawa et al.

[11] Patent Number: 5,942,710

[45] Date of Patent: Aug. 24, 1999

[54] AUTOMATIC ACCOMPANIMENT APPARATUS AND METHOD WITH CHORD VARIETY PROGRESSION PATTERNS, AND MACHINE READABLE MEDIUM CONTAINING PROGRAM THEREFORE

[75] Inventors: Tokuji Hayakawa; Masao Ishibashi, both of Hamamatsu, Japan

[73] Assignee: Yamaha Corporation, Japan

[21] Appl. No.: 09/003,169

[22] Filed: Jan. 6, 1998

[30] Foreign Application Priority Data

Jan. 9, 1997 [JP] Japan ..... 9-002389

[51] Int. Cl.[6] ..... G10H 1/38

[52] U.S. Cl. ..... 84/637; 84/669; 84/DIG. 22

[58] Field of Search ..... 84/613, 637, 650–652, 84/669, 715, DIG. 22

[56] References Cited

U.S. PATENT DOCUMENTS

| | | | |
|---|---|---|---|
| 3,889,568 | 6/1975 | Amaya | 84/DIG. 22 |
| 4,381,689 | 5/1983 | Oya | 84/DIG. 22 |
| 4,499,807 | 2/1985 | Ishida | 84/DIG. 22 |
| 5,052,267 | 10/1991 | Ino | 84/613 |
| 5,056,401 | 10/1991 | Yamaguchi et al. | 84/637 X |
| 5,218,153 | 6/1993 | Minamitaka | 84/613 |
| 5,218,157 | 6/1993 | Akagawa et al. | 84/637 |
| 5,260,510 | 11/1993 | Shibukawa | 84/637 |
| 5,294,747 | 3/1994 | Bruti et al. | 84/669 |
| 5,481,066 | 1/1996 | Kitamura | 84/637 |
| 5,510,572 | 4/1996 | Hayashi et al. | 84/609 |

*Primary Examiner*—Stanley J. Witkowski
*Attorney, Agent, or Firm*—Rossi & Associates

[57] ABSTRACT

An automatic accompaniment apparatus stores a plurality of chord variety progression patterns corresponding to the respective types of chords. Each chord variety progression pattern is constituted by a subprogression of plural chords provided for the corresponding chord type. When a player designates chords in progression to be used for an automatic accompaniment performance, the chord type of each designated chord is detected, and each single chord will be substituted by a chord variety progression pattern for the chord type which is the same as such a designated single chord, under the condition that the chord variety progression function is made operative for such a designated chord and that such a designated chord is of a type for which a chord variety progression pattern is provided correspondingly. As the player performs a chord progression of a slower change, the apparatus realizes a modified complex chord progression with a faster chord change to enhance the variousness in chord progressions. The chord variety progression pattern may further include on/off control data for the accompaniment pattern and wavy control data for performance volume variation, thereby adding further variety in accompaniment performance.

12 Claims, 13 Drawing Sheets

RESULTANT PERFORMANCE WHEN CHORD VARIETY PROGRESSION IS OFF

RESULTANT PERFORMANCE WHEN CHORD VARIETY PROGRESSION IS ON

AUTOMATIC ACCOMPANIMENT APPARATUS AND METHOD WITH CHORD VARIETY PROGRESSION PATTERNS, AND MACHINE READABLE MEDIUM CONTAINING PROGRAM THEREFORE

BACKGROUND OF THE INVENTION

1. Field of the Invention

The present invention relates to an accompaniment apparatus capable of performing automatic musical accompaniment by playing back memorized accompaniment chord progression patterns, and more particularly to such an accompaniment apparatus storing chord variety progression patterns for respective types of chords and automatically introducing variousness in the chord progression based on even a simple chord progression consisting of a small number of chords which are designated by the musical instrument player using a keyboard or the like.

2. Description of the Prior Art

Among conventional musical instruments having the function of automatic accompaniment, there is such a kind of musical instrument that stores accompaniment patterns constituted by note codes representing a progression of chords in a normalized tonality key, detects the chords played by the player based on the manipulated keys in the chord region (e.g. lower side keyboard region), and converts the note codes of the normalized accompaniment patterns based on the root note and the type of the detected chord to provide an automatic accompaniment with a proper chord progression as matches the designated chords. As the ways of designating (inputting) the chords through the keyboard manipulation, there are various types such as a type usually referred to as a "fingered chord" method in which the keys of the all constituent notes of a chord are actually depressed to designate an intended chord and a type usually referred to as a "single finger" method in which minimal (usually one, two or three) keys are depressed according to the predetermined designation rule to designate an intended chord. Among these, the "fingered chord" mode is for the advanced level players, while the "single finger" mode is for the beginners by way of easier chord designation.

The "single finger" mode designation, however, can designate only a few types of simple fundamental chords such as a major chord, a minor chord, a seventh chord and a minor seventh chord, and thus involves a problem that an automatic accompaniment with versatile variations may not be possible as it lacks ways of designating complicated chords and consequently lacks ways of composing a complex chord progression.

SUMMARY OF THE INVENTION

It is, therefore, a primary object of the present invention to provide an automatic accompaniment apparatus capable of presenting chord progressions with faster and complex chord variations by merely designating simple chord progressions with slower chord variations.

Another object of the present invention is to provide an automatic accompaniment apparatus capable of performing a modified chord subprogression consisting of variety of chords with a faster chord change in response to and in place of a single simple designated chord included in a chord progression of a slower change as designated by the player.

Still another object of the present invention is to provide a machine readable medium containing computer programs for realizing an automatic accompaniment apparatus capable of performing a modified chord subprogression consisting of variety of chords with a faster chord change in response to and in place of a single simple designated chord included in a chord progression of a slower change as designated by the player.

According to the present invention, the object is accomplished by providing an automatic accompaniment apparatus which comprises chord progression pattern storing means for storing a plurality of sets of chord subprogression patterns which are provided corresponding at least to types of chords; chord designating means for designating chords by an operator; chord detecting means for detecting the chords designated by the operator, each chord having a type and a root note; chord progression pattern selecting means for selecting a chord subprogression pattern which corresponds to the type of the detected chord; and accompaniment performing means for automatically performing an accompaniment for given music by presenting chords in a progression based on the selected chord subprogression pattern.

According to the present invention, the object is further accomplished by providing a machine readable medium for use in an automatic accompaniment apparatus of a data processing type comprising a computer and chord designating means for designating chords by an operator, which medium contains program instructions executable by the computer for causing the automatic accompaniment apparatus to perform the steps of: providing a plurality of sets of chord subprogression patterns corresponding at least to types of chords; detecting the chords designated by the operator, each of which chords is identified by a type and a root note; selecting a chord subprogression pattern which corresponds to the type of the detected chord from among the plurality of sets of chord subprogression patterns; and automatically performing an accompaniment for given music by presenting chords in a progression based on the selected chord subprogression pattern.

According to the present invention, there is provided a chord subprogression pattern consisting of a set of modified chords arranged in a sequence for at least a chord type, and when a chord is designated by the player during the automatic accompaniment operation, the designated single chord can be substituted by the chord subprogression pattern for the chord type which is the same as the type of the designated chord, whereby a simple chord progression with slower changes as designated by the player will turn into a complex chord progression with faster changes.

According to an aspect of the present invention, there is provided an automatic accompaniment apparatus and method, and a machine readable medium containing computer programs for realizing an automatic accompaniment apparatus in which the chord subprogression pattern for a chord type is comprised of plural different chords including a tonic chord and at least another chord, all of which chords are normalized on a predetermined root note with reference to the tonic chord, and the accompaniment performing means presents chords to perform an accompaniment by shifting the normalized chords constituting the selected chord subprogression pattern based on the difference between the root note of the detected chord and the root note of the tonic chord. With this configuration, a single chord subprogression pattern can be utilized to produce twelve different chord subprogression patterns for twelve different chords having a same type but different root notes, thereby minimizing the necessary capacity of the storage device.

According to another aspect of the present invention, there is provided an automatic accompaniment apparatus and method, and a machine readable medium containing computer programs for realizing an automatic accompaniment apparatus in which there is provided a plurality of automatic accompaniment patterns and a plurality of sets of chord subprogression patterns for each one of the automatic accompaniment patterns, and in which the chord subprogression pattern to be utilized for the automatic accompaniment performance is selected from among those prepared for the particular automatic accompaniment pattern that is to be performed as an accompaniment to given music. With this configuration, a maximally suitable chord progression will be realized to meet the respective automatic accompaniment patterns.

According to still another aspect of the present invention, there is provided an automatic accompaniment apparatus and method, and a machine readable medium containing computer programs for realizing an automatic accompaniment apparatus in which an automatic accompaniment performance can be conducted based on the type of the designated chord directly without introducing a prepared chord subprogression pattern, in case the type of said detected chord is different from the type of any of the chords for which the chord subprogression patterns are prepared. With this configuration, an advanced player may designate some non-standard complex chords (i.e. chords different from those detectable by this apparatus) thereby enhancing the accompaniment performance.

According to still further aspect of the present invention, there is provided an automatic accompaniment apparatus and method, and a machine readable medium containing computer programs for realizing an automatic accompaniment apparatus in which a plurality of sets of chord progression patterns are read out in parallel as a preparation for use at changes of chords in the middle of the performance of a presently running chord subprogression pattern. With this configuration, the chord progressions presented by the apparatus of this invention will exhibit a smooth and natural flow or change of chord progression even when the chord designation may be changed in the middle of the running chord subprogression pattern.

Alternatively according to the present invention, a plurality of chord subprogression may be provided corresponding to types and root notes of chords, i.e. each chord type of each root note may have an assigned chord subprogression pattern separately, as long as there is enough capacity in the memory. Then the read out chord subprogression pattern has its own chord type and root note and therefore can be directly utilized to shift the accompaniment pattern data with respect to root note.

BRIEF DESCRIPTION OF THE DRAWINGS

For a better understanding of the present invention, and to show how the same may be carried into effect, reference will now be made, by way of example, to the accompanying drawings, in which.

DESCRIPTION OF THE PREFERRED EMBODIMENTS

Figure 1:
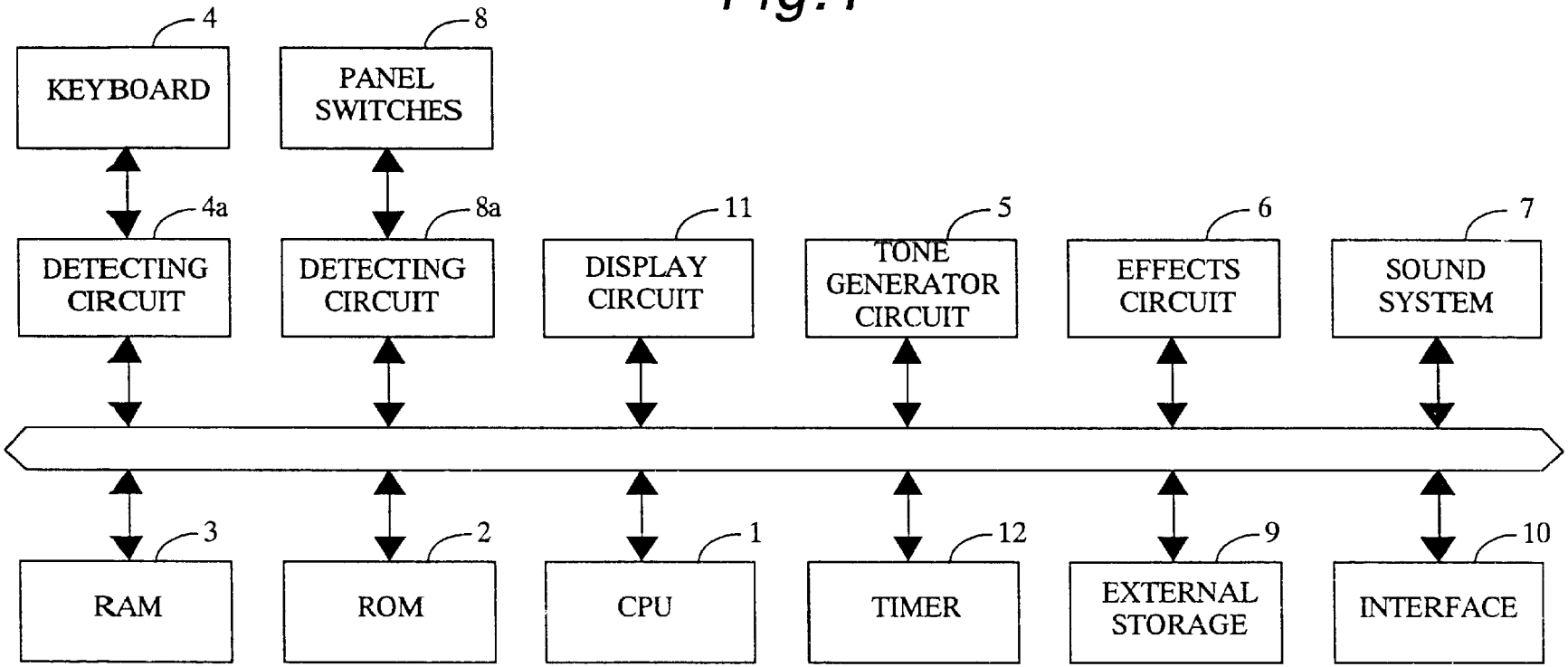
FIG. 1 is a block diagram of an embodiment of an electronic musical instrument incorporating the present invention.

Illustrated in FIG. 1 of the drawings is a general block diagram of an example of a musical instrument incorporating the present invention. A CPU 1 is to control the general operation of the electronic musical instrument based on a control program stored in a ROM 2 using working areas in a RAM 3. During a performance on the instrument, key codes, key-on signal, etc. which represent the respective key manipulations in a keyboard 4 are taken out via a detecting circuit 4*a*, and are sent to a tone generator circuit 5 to generate corresponding musical tones, which in turn are imparted with desired sound effects through an effects circuit 6 and are finally converted into audible sounds by a sound system 7. The tone generator circuit 5 is of a type capable of generating a plurality of tones substantially simultaneously by time-division-multiplexed processing of a plurality of time-divided channels so that an ensemble performance may be possible by an instrument player's performance and an automatic accompaniment of plural music parts.

When the automatic accompaniment function is rendered operative, chords are designated by the player using the keyboard 4 according to either the single-finger mode or the fingered-chord mode, and such chords are detected based on the presently selected mode. The CPU 1 then reads out accompaniment patterns (rhythmic arrangements of notes for chords and basses) which are preset in the ROM 2 or accompaniment patterns memorized in the RAM 3 in accordance with the presently selected accompaniment style to automatically perform the proper accompaniment with the designated chords. Under such a condition, if the hereinafter described "chord variety progression off" mode is designated, the accompaniment patterns are to be simply pitch-converted based on the designated chords for the automatic performance similarly as in the case of an ordinary automatic accompaniment apparatus, whereas if the hereinafter described "chord variety progression on" mode is designated, chord variety progression patterns are to be selected out from among those stored in the ROM 2 and the RAM 3 based on the designated accompaniment style and music section and on the detected chords (correspondingly one after another) and the accompaniment patterns from the ROM 2 and the RAM 3 are pattern-modified and pitch-converted based on the detected chords and the selected chord variety progression patterns to automatically realizing a more complicated chord progression than the actually designated chords played by the instrument player.

There are various panel switches 8 provided in the control panel similarly as in the conventional electronic musical instruments although not shown specifically here in the drawings, and the CPU 1 detects the respective actuation events of the panel switches 8 via a detecting circuit 8*a* and conducts the corresponding processings in accordance with the actuation events of the respective panel switches 8. In these processings according to the actuation events, the CPU 1 conducts processing of switching the accompaniment style, processing of start/stop control of an automatic accompaniment, processing of switching over music sections for pattern modifications of the automatic accompaniment, processing of switching over the on/off modes of the chord variety progression, processing of switching over the chord designation modes of the fingered chord and the single finger, and so forth. Further, the CPU 1 handles input processing of accompaniment progression patterns and chord variety progression patterns from an external storage device 9, or accompaniment patterns and chord variety progression patterns to be supplied from other external apparatuses (although not shown) via an interface 10, display control processing for a display circuit 11, and so forth.

A timer 12 is to generate interrupt signals at necessary timings on the timings determined by the time resolution (e.g. an interval of 384th note length, i.e. 12×32nd note duration) of the system for the tempo information and the accompaniment data to be set by the CPU 1. With such interrupt signals, the CPU 1 conducts interrupt operations to control the automatic accompaniment. The CPU 1 further divides these interrupt signals to conduct interrupt operations at other timings corresponding to the resolution (e.g. an interval of 16 note length) as determined for the chord variety progression patterns.

Figure 2:
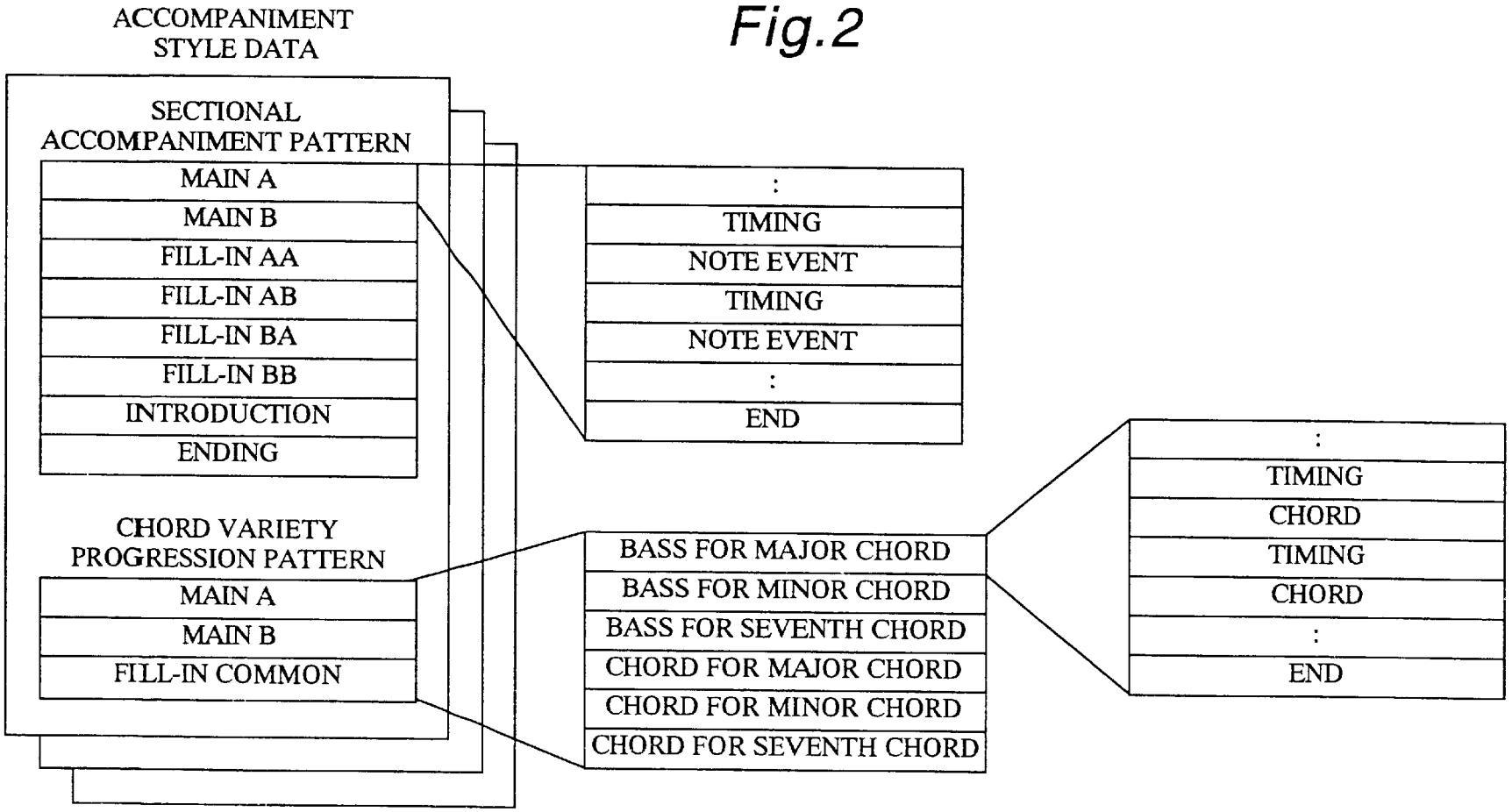
FIG. 2 is a data format chart of accompaniment style data including sectional accompaniment patterns and chord variety progression patterns for each style of accompaniment in a first embodiment of the invention.

FIG. 2 is a data format chart of a sectional accompaniment pattern and a chord variety progression pattern to be prepared for each accompaniment style. An automatic accompaniment performance is to be conducted upon selection of the performance style according to the kind (genre) of music such as jazz and rock music, and therefore the embodiment contains an accompaniment style data set for each of the performance styles. FIG. 2 shows three data sets as illustrated by piled three sheets of tables. Each accompaniment style data set includes accompaniment patterns for a plurality of music sections and chord variety progression patterns for a plurality of music sections. The term "section" herein used means a certain span (time length) of accompaniment to be used for a certain portion in the time flow of a piece of music such as a main section (verse section) accompaniment to be used for the general accompaniment of the main portion of music, a fill-in section accompaniment to be used for the fractional portion of music to complicate the music performance temporarily, an introduction section accompaniment to be typically used for the introductory portion of music, and an ending section accompaniment to be typically used for the ending portion of music. These accompaniment sections are selectively employed for adequate accompaniment performance to the respective portions of music.

Each of the sectional accompaniment patterns is comprised of a bass part accompaniment pattern, a chord part accompaniment pattern and a rhythm part accompaniment pattern, wherein each pattern includes note (or tone) event data representing the respective notes (or percussion tones) to be used for the accompaniment, timing data representing the respective time intervals each from a note event to the succeeding note event, and end data. The note event data for each note includes note on/off data, note number data, key velocity data, etc for the note. The timing data for each span represents the duration of the preceding note by a value measured with the predetermined time resolution, e.g. a time length corresponding to the 384th note (one twelfth of a thirty-second note duration). The accompaniment pattern may further include other data than the note event data, for example, pitch bend data and volume data. The number and the kind of the sections to be prepared are not necessarily limited to those mentioned above. The length of each accompaniment pattern can be one or more measures (bars), and may be of the same length as that of the chord variety progression pattern or may be different.

The chord variety progression pattern i s a pattern of subprogression of chords to be substituted for a single still chord which is included in a performance progression of the chords as designated one after another by the player of an electronic musical instrument. The chord variety progression patterns for each section are provided for two different parts, i.e. a bass part and a chord part and can be different for the different parts. Or a common chord variety progression pattern can of course be used for the bass part and for the chord part. The chord variety progression patterns are provided respectively for the major chord, the minor chord and the seventh chord for each of the parts to maximally meet the types of the chords as would be designated by the instrument player during operation of the automatic accompaniment mode. Each of the chord variety progression patterns is constituted by a subprogression of chords to fractionally modify a corresponding chord to realize a rich chord variation suitable for the corresponding type of chord (i.e. major, minor or seventh), but some types may share a same pattern, for example, a single pattern being for the major chord and the seventh chord. Fundamentally speaking, every section is provided with its own chord variety progression pattern(s), but some of the sections may not include a chord variety progression pattern. For example, in FIG. 2, there is no chord variety progression pattern provided for the introduction section and the ending section. Further, plural sections may share one chord variety progression pattern. For example, in FIG. 2, a common chord variety progression pattern, i.e. a "fill-in common" for the fill-in AA through the fill-in BB sections.

The chord variety progression pattern is comprised of chord data, timing data and end data. The chord data includes the root note and the type of the chord, and sometimes may include non-root bass information. A non-root bass chord is a chord consisting of the chord constituent notes and the bass note which is different from the root note, namely a chord on a non-root note bass. The timing data represent the time interval between the two adjacent chord data with a value expressed in terms of a predetermined time resolution (in this embodiment, a sixteenth note duration). The chord variety progression pattern may be of a length of one measure (bar) or more, where the longer the pattern is, the richer the variation of the automatic accompaniment performance becomes. For example, even a short accompaniment pattern may be played back repeatedly, a chord variety progression pattern having some amount of length would present a feeling of playing back a longer accompaniment pattern.

Figure 3:
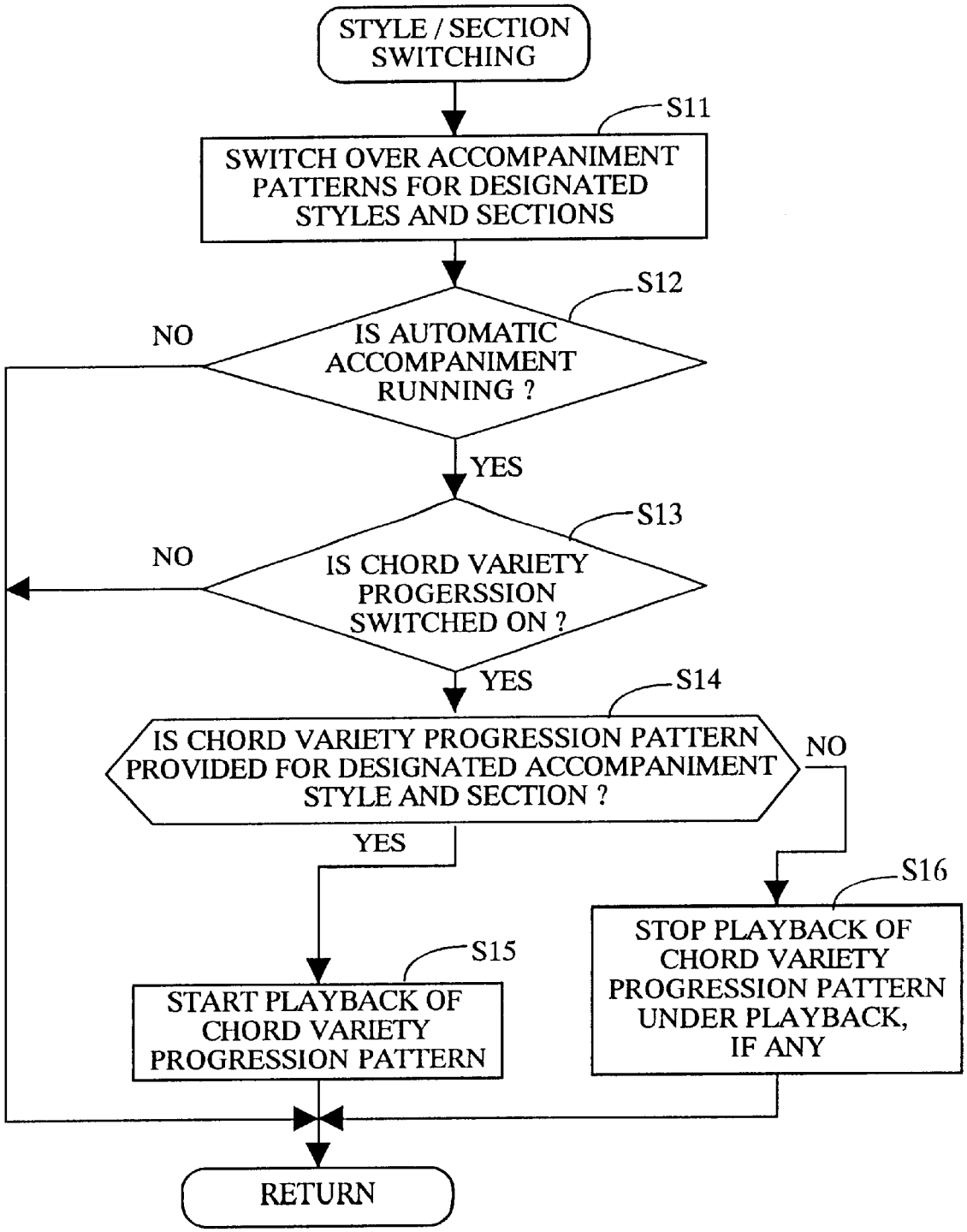
FIG. 3 is a flow chart of a process of switching accompaniment styles and accompaniment sections.
Figure 4:
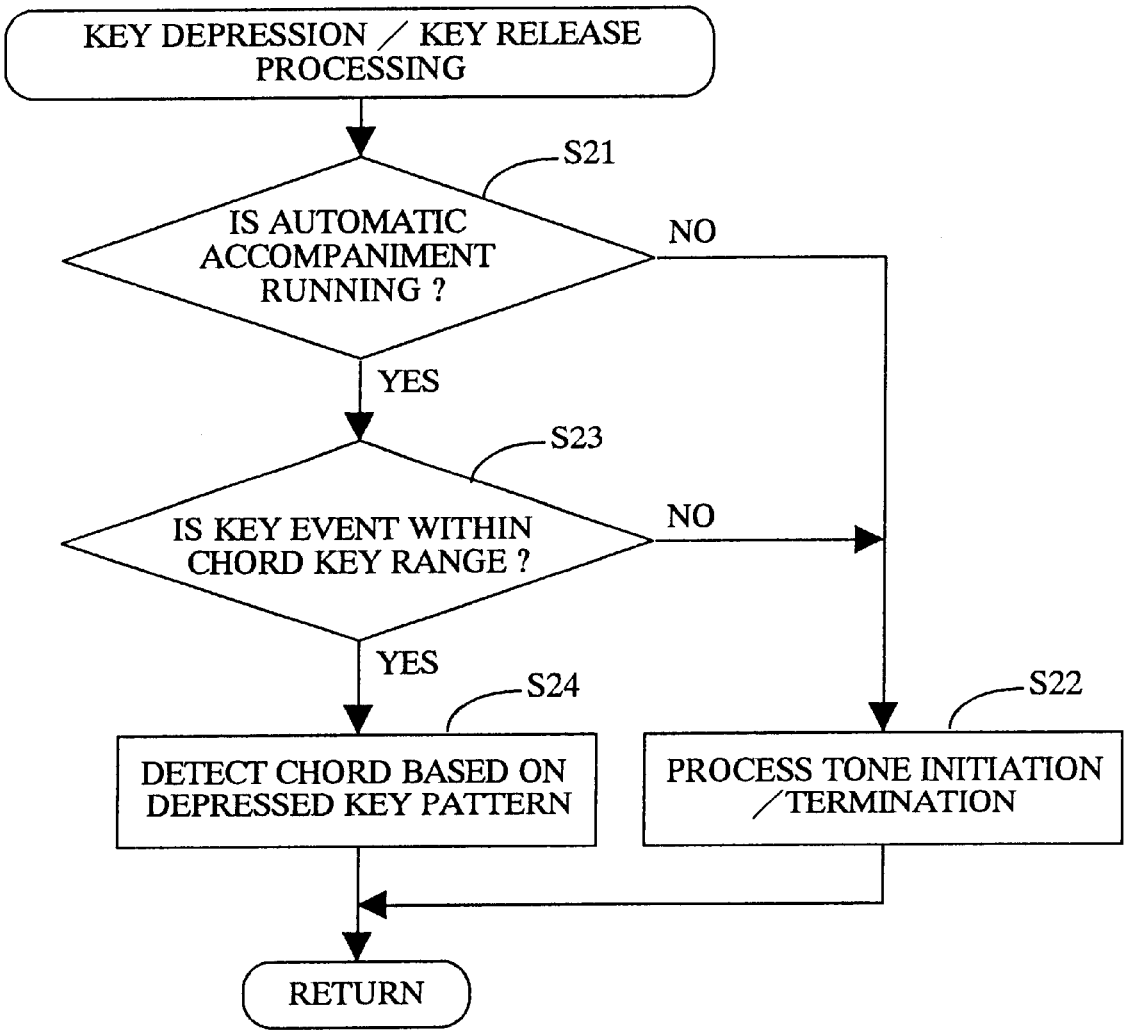
FIG. 4 is a flow chart of a process of key depression and key release processing.
Figure 5:
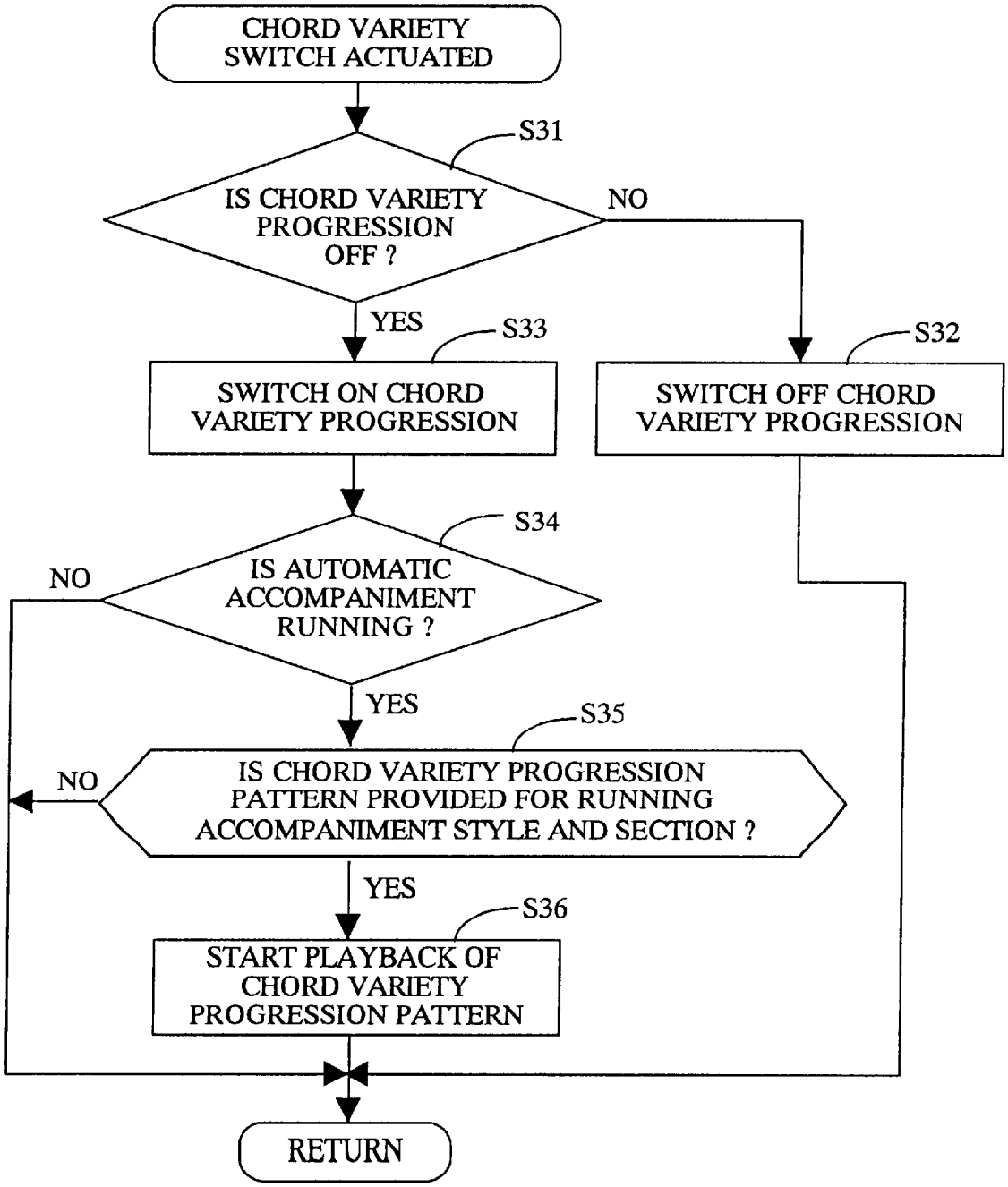
FIG. 5 is a flow chart of a process of chord variety switch processing.

FIGS. 3–8 are flow charts of essential parts of the control program executed by the CPU 1, and therefore with reference to these flow charts the controlling operations of the CPU 1 will be described hereinafter. FIG. 3 shows a process routine to be conducted in response to a switch actuation event of the accompaniment style change over switch or of the accompaniment section change over switch among the panel switches 8, FIG. 4 shows a process routine to be conducted in response to a key event which means an event of depression or release of a key in the keyboard 6, and FIG. 5 shows a process routine to be conducted in response to a switch actuation event of the chord variety progression switch. All of these events are detected by means of the main program routine (not particularly shown), and then the processings are directed to the respectively corresponding unique process routines.

First referring to FIG. 3, the process of accompaniment style/section switching is initiated upon detection of the actuation of the accompaniment style change-over switch or of the accompaniment section change-over switch, and is started with the execution of step S11. The step S11 switches over the accompaniment patterns to be played back to the accompaniment patterns prepared for the accompaniment style and the accompaniment section as are designated by the player. Step S12 judges whether the automatic accompaniment is now running, and if not running, the program returns to the former processing. If the automatic accompaniment is on the go, the processing moves to step S13 to judge whether the chord variety progression mode is set on. These judgments of whether the automatic accompaniment is running and whether the chord variety progression mode is set on are made based on the corresponding flags which are made to flip over respectively in response to the actuation events of the automatic accompaniment start/stop switch and the chord variety progression switch, respectively.

If the step S 13 judges the chord variety progression mode is not set on, the processing returns to the former routine (main program routine). If the chord variety progression mode is set on, the processing moves forward to step S14 to judge whether there is provided a chord variety progression pattern for the designated accompaniment style and section. If such a chord variety progression pattern is prepared, the processing moves to step S15 to start playing back the said prepared chord variety progression pattern. This start of playing back means, if microscopically speaking, to enable interruption of chord reading at every 16th note time span, and does not necessarily mean that this step S15 will immediately initiate the playback of the captured chord variety progression pattern. If a chord variety progression pattern is not found corresponding to the accompaniment style and section as designated in the step S14, the processing moves to step S16 to disable the above interruption and stop the playback of the chord variety progression pattern which is now being played back, if any, and then returns to the former routine.

In the key depression/key release processing of FIG. 4, step S21 judges whether the automatic accompaniment is running or not, and if the answer is "no", then the processing moves to step S22 to execute the process of tone initiation/termination corresponding to the key event for the ordinary tone start/stop, and then to return to the former routine. If the answer is "yes", the processing moves forward to step S23 to judge whether the key event has occurred within the chord key range. If the key event is not within the chord key range, the processing moves to the step 22 for the tone initiation/termination process and thereafter returns to the former processing. If the key event is within the chord key range, the processing moves forward to step 24 to detect the chord being designated based on the depressed key pattern before returning to the former routine. The detection of the chord by the step S24 is conducted by either of the detection modes of the "fingered chord" mode and the "single finger" mode, whichever is now being selected.

The chord variety progression switch processing of FIG. 5 is initiated upon actuation of the chord variety progression on/off switch. First, step S31 judges whether the chord variety progression has been in its "off" state up to now. If the state has not been "chord variety progression off", the detected actuation of the chord variety progression switch indicates that the player has just now designated the "off" switching under the "on" state, and therefore the processing operation switches off the chord variety progression function at step S32 before returning to the former routine. If the step S31 judges that the chord variety progression has been in its "off" state, the detected actuation of the chord variety progression switch indicates that the player has just now designated the "on" switching under the "off" state, and therefore the procession operation switches on the chord variety progression function at step S33 before going to step S34. The step S34 is to judge whether the automatic accompaniment is now running.

If the step S34 judges the automatic accompaniment is not running, the processing returns to the former routine. If the automatic accompaniment function is in operation, the processing moves forward to step S35 to judge whether there are prepared chord variety progression patterns for the accompaniment style and section under performance. If there is no chord variety progression pattern prepared therefor, the processing returns to the former routine. If a chord variety progression pattern is found to be prepared for the performing accompaniment style and section, step S36 starts playing back the said found chord variety progression pattern before returning to the former routine.

In the above-mentioned processes, every actuation of the chord variety progression switch changes over the designated states between "chord variety progression on" and "chord variety progression off". Thus, when the state is changed from the "chord variety progression off" state to the "chord variety progression on" state during the automatic accompaniment is functioning, the chord variety progression pattern will be played back from that moment on.

Figure 6:
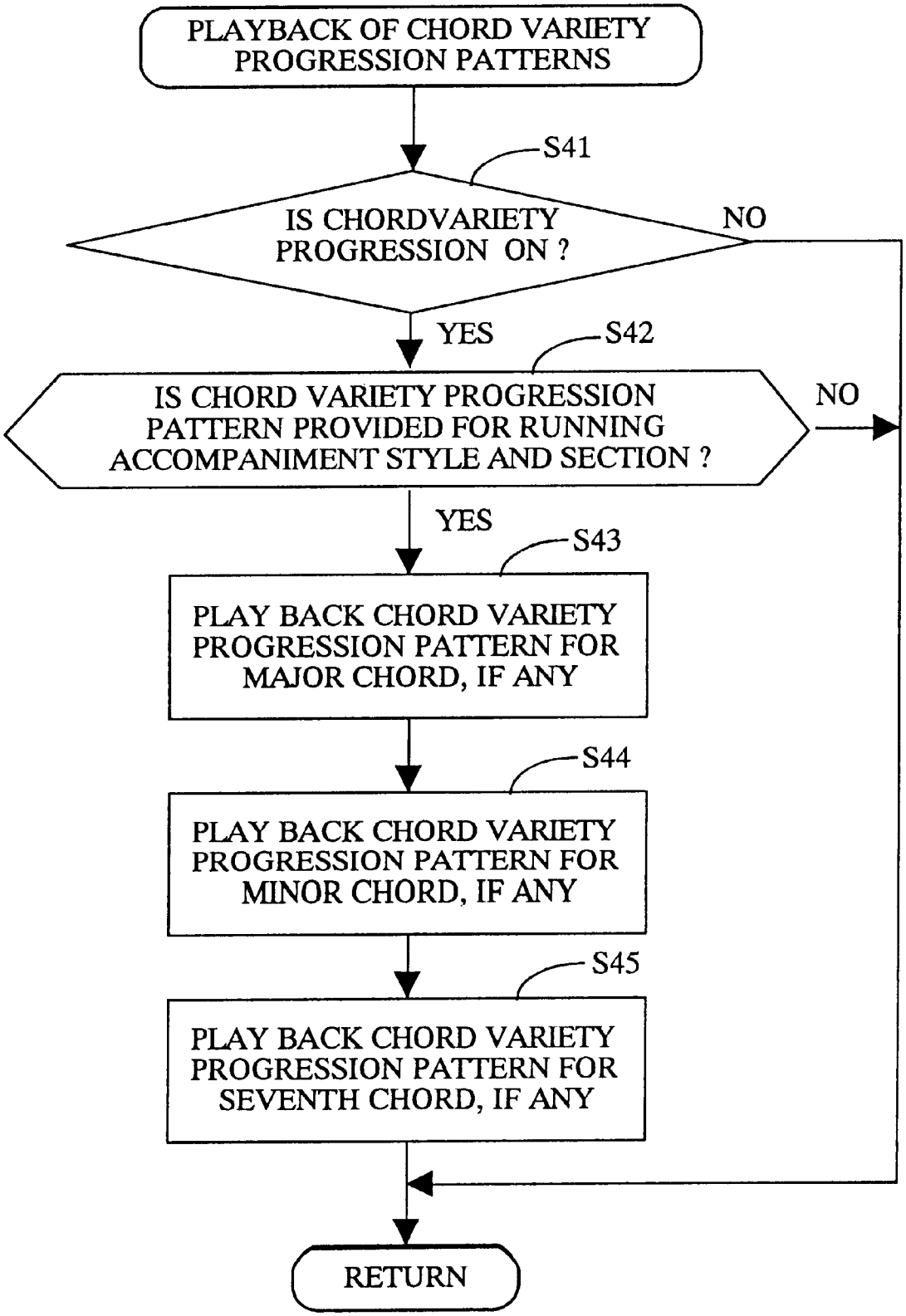
FIG. 6 is a flow chart of a process of playing back chord variety progression patterns.

The playback processing of the chord variety progression patterns of FIG. 6 is to be started every 16th note time span for introducing proper variety patterns into major chords, minor chords and seventh chords, respectively, in the chord progression. Step S41 judges whether the chord variety progression is switched "on". If the chord variety progression is not set on, the processing returns to the former routine. If the chord variety progression is switched on, the processing moves forward to step S42 to judge whether there are any chord variety progression patterns provided for the accompaniment style and section now under performance. If no such chord variety progression pattern is prepared, the processing returns to the former routine without doing anything. If there are any such chord variety progression patterns provided for the running accompaniment style and section, the processing moves forward to steps S43, S44 and S45 in succession before returning to the former routine. The step S43 is to play back the chord in the chord variety progression pattern for the major chord at this moment, if such is provided. The step S44 is to play back the chord in the chord variety progression pattern for the minor chord at this moment, if such is provided. The step S45 is to play back the chord in the chord variety progression pattern for the seventh chord at this moment, if such is provided.

While the processing routine of FIG. 6 plays back the chords in all of the three kinds of chord variety progression patterns for the major chord, the minor chord and the seventh chord simultaneously by means of steps S43, S44 and S45, all of them are not necessarily be utilized immediately in the automatic accompaniment performance. Among the three chord variety progressions, only one chord variety progression for the chord type that is identical with the type of the chord which is now being designated on the keyboard in its chord key region will be utilized. The parallel playback (i.e. readout) of three kinds of chord variety progression patterns is to prepare for any instantaneous changes in the designation of the chords so that immediate utilization of the chord in the chord variety progression should be possible in the automatic accompaniment to meet the designated chord type. By playing back (i.e. reading out the data of) the three types of chord variety progression patterns in parallel, synchronization in progression of those different chord types can easily be secured so that any unnatural change would not occur even when the chord variety progression patterns are switched over in the middle of its progression. If the chord progression in a piece of music would be constituted by only one type of the chords, various kinds of effective modification to the chord progression could easily be employed to enrich the performance. But if such a modification would be conducted separately with the different chord types, some disconnection feeling would happen at the time the chord types changes in the middle of the one-set-pattern-length of the modified chord progression. To avoid such an inconvenience, this invention employs the provision of the chord variety progression patterns taking the correlations between the three different chord types in the progression into consideration, and the simultaneous playback of three type of the chord variety progression patterns at all times, so that the chords will change smoothly and naturally even when the chord types are changed during the progression of a set of chord variety progression pattern.

As the chord variety progression pattern is played back (read out) from the format and comes to the "end" data, then the pattern is to be played back (read out) from its beginning again. This repeated playback continues as long as the playback of the same pattern is kept designated. Therefore, when a same chord is designated on the keyboard for a period of time which is longer than the length of the prepared chord variety progression pattern, a same series of chord progression will be repeated.

Figure 7:
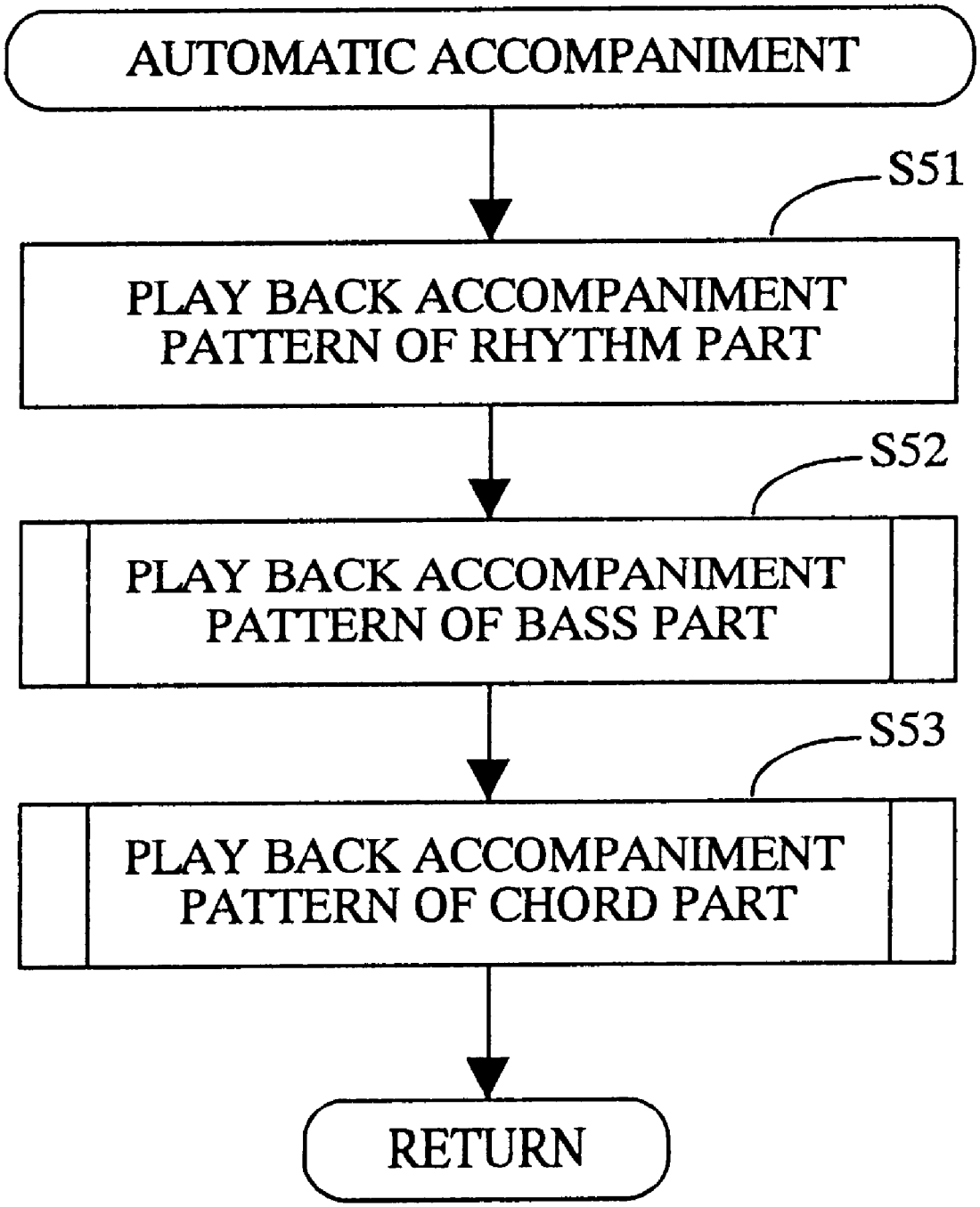
FIG. 7 is a flow chart of an automatic accompaniment processing.

FIG. 7 is a flow chart of the automatic accompaniment processing which is executed when the automatic accompaniment mode is set "on". The processing is repeatedly initiated at a time interval of the 384th note duration, i.e. one twelfth of the 32nd note. Step S51 performs the processing of playing back the accompaniment patterns for the rhythm part. Step S52 performs the processing of playing back the accompaniment patterns for the bass part. Step S53 performs the processing of playing back the accompaniment patterns for the chord part. Further details of the steps S52 and S53 will be described with reference to FIG. 8 in common. After these three steps S51, S52 and S53, the processing goes forward to return to the former routine. The accompaniment patterns which are played back here are such accompaniment patterns that are provided for the accompaniment style and the accompaniment section presently under performance. In this automatic accompaniment processing, the "end" data in the respective accompaniment patterns are different depending on the section of the accompaniment. Specifically, in case of the main section, the "end" data let the playback of the accompaniment pattern go back to its beginning to repeat the same. In case of the introduction section, the "end" data let the playback of the accompaniment pattern go to the main-A section. In case of the fill-in section, the "end" data let the playback of the accompaniment pattern go to the main-A section (in case of fill-in AA and BA) or to the main-B section (in case of fill-in AB and BB). In case of the ending section, the "end" data let the playback of the accompaniment pattern stop there. As these technology is conventional in the art, the detailed description thereof is omitted here.

Figure 8:
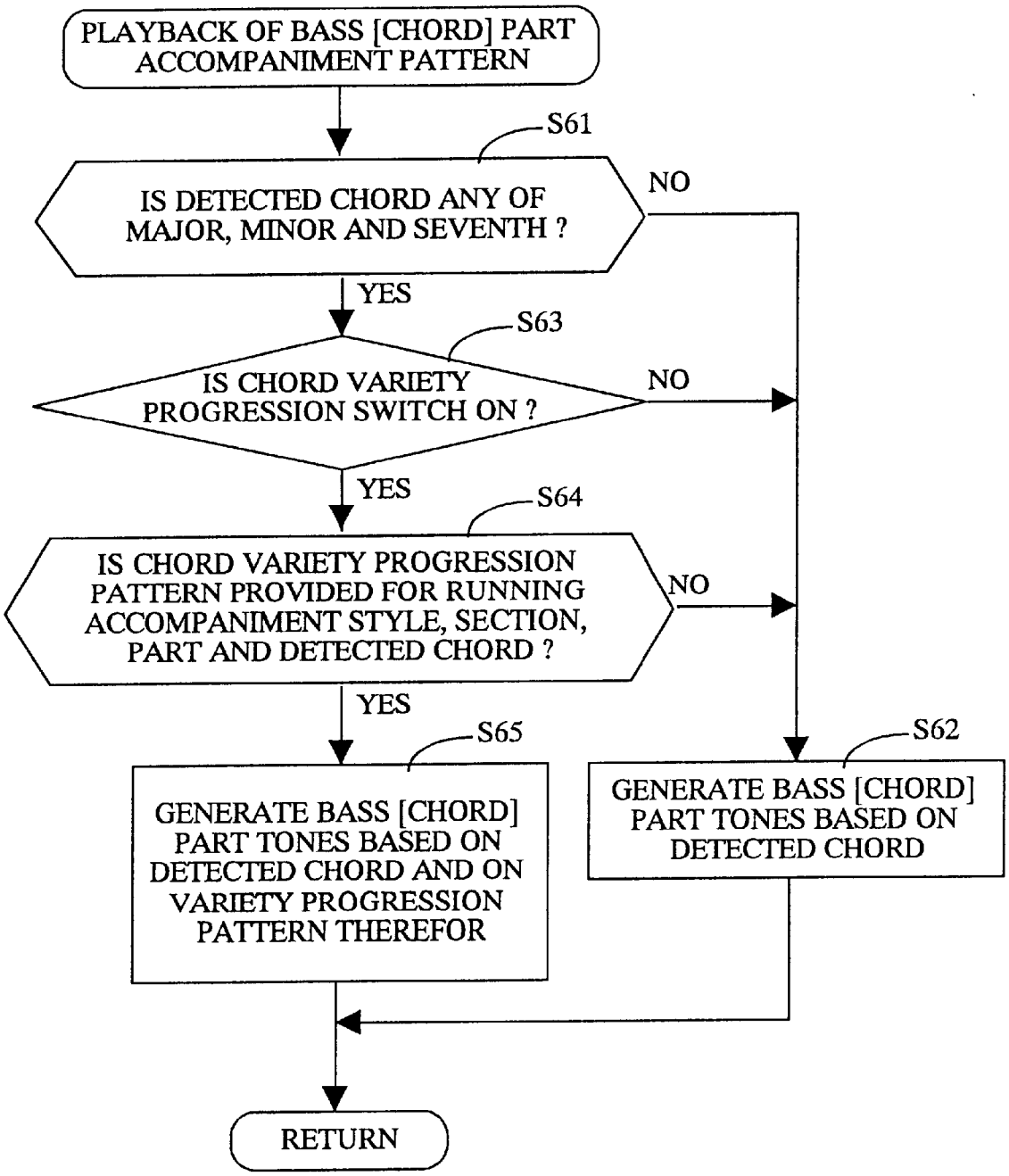
FIG. 8 is a flow chart of a process of playing back sectional accompaniment patterns of the bass [or chord] part.

FIG. 8 is a flow chart of the playback of the accompaniment patterns for the bass part and for the chord part. The two processing flows are common in description of the respective steps, except the processing is for the bass part or for the chord part. Therefore, FIG. 8 shows the flow chart for the bass part and the flow chart for the chord part in common by expressing the "bass part" outside the brackets and the "chord part" inside the brackets as "bass [chord] part". Therefore, it should be interpreted that only the term "bass" be employed for the bass part processing, while the term "chord" be employed for the chord part in place of the term "bass". The following description will be in the same manner. First in step S61, the judgement is made as to whether the detected chord is any of the major chord, the minor chord and the seventh chord. If the detected chord is none of them, the processing moves to step S62 to generate bass [chord] part tone(s) based on the type and the root note of the detected chord, i.e. by shifting the note pitch(es) of the ordinary bass [chord] part accompaniment of a normalized chord configuration depending on the root note of the detected chord without introducing a chord variety subprogression. The processing thereafter returns to the former routine. Thus, the chords prepared in the chord variety progression pattern (chord subprogression pattern) are not employed in this instance, but instead the chords designated by the operator in the chord key region are reflected in the ordinary automatic accompaniment performance.

If the detected chord is any one of the major, minor and seventh chords, the processing moves forward to step S63 to judge whether the chord variety progression switch is turned on, i.e. the chord variety progression mode is on the go. If not "on", the processing goes to the step S62 to conduct the above-mentioned operation and then in turn returns to the former routine. If the mode is rendered operative, the processing moves forward to step S64 to judge whether there are prepared chords to constitute the chord variety progression pattern corresponding to the presently running accompaniment style, section and part, and to the detected chord (major, minor or seventh). If not prepared, the processing goes to the step S62 and thereafter returns to the former routine. If there is a corresponding chord variety progression pattern found, the processing moves forward to step S65. In the step S65, the chords played back from the above-mentioned corresponding chord variety progression pattern (normalized) are shifted in pitch according to the root note of the chord detected from the depression of keys in the chord key region, then the notes in the normalized bass [chord] part accompaniment are pitch-converted based on the root note and the type of those shifted chords in the chord variety progression pattern thereby sounding audible tones for music performance, and finally the processing returns to the former routine.

According to the above-mentioned processing flow, when a minor seventh chord is designated under the single finger mode or a complicated chord other than a major chord, a minor chord and a seventh chord is designated under the fingered chord mode during the state of "chord variety progression mode on", the chord variety progression patterns which have been played back through the processing flow of FIG. 6 will not be utilized here in the processing flow of FIG. 8 for the bass [chord] part tone generation, but instead the bass [chord] part accompaniment will be performed with the very designated chord itself. When a major, a minor or a seventh chord is designated during the state of "chord variety progression mode on", the bass [chord] part accompaniment will be of the chord variety progression pattern, as long as there is provided any chord variety progression pattern corresponding to the prevailing accompaniment style, section and part and the detected chord in the keyboard.

According to the above-described embodiment, if the style change over switch or the section change over switch is actuated amidst the automatic accompaniment, the accompaniment patterns and the chord variety progression patterns will immediately be changed accordingly. But such pattern changes may be at another timing, for example such pattern changes may be delayed until the timing of a predetermined boundary such as a bar line.

Figure 9A:
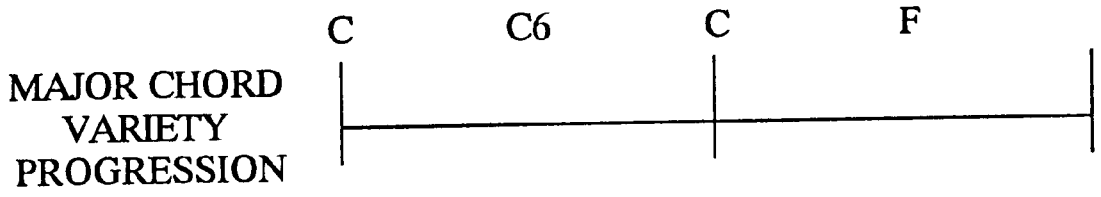
FIGS. 9A–9C are time charts illustrating examples of the chord variety progression patterns in the first embodiment of the invention.
Figure 9B:
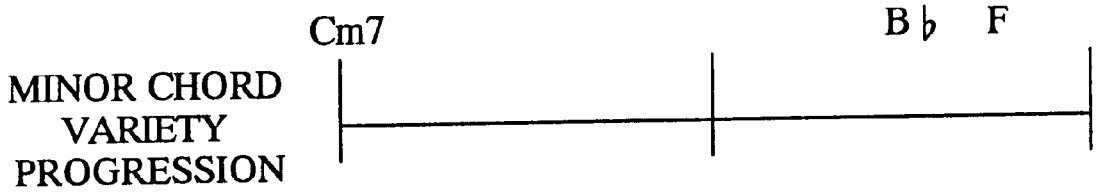
Figure 9C:
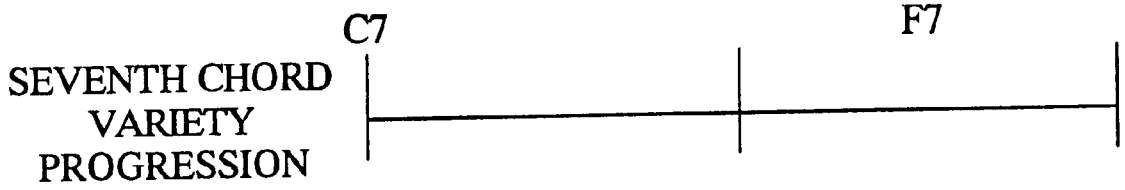

FIGS. 9A–9C are to illustrate examples of chord variety progression patterns for visual understanding. Each pattern is constructed by two measures (vertical lines represent bar lines) in these examples. FIG. 9A shows a chord variety progression pattern for a major chord, and has a chord progression pattern of C→C6→C→F, each having a duration of a half measure. FIG. 9B shows a chord variety progression pattern for a minor chord, and has a chord progression pattern of Cm7→Bb→F, respectively having durations of one and a half measures, a quarter measure and a quarter measure. FIG. 9C shows a chord variety progression pattern for a seventh chord, and has a chord progression pattern of C7→F7, respectively having durations of one and a half measures and a half measure. The chords in these examples are all normalized with reference to the tonic chord having the root note of C. So in the actual accompaniment performance, the chords in these variety patterns are shifted in pitch in accordance with the root note of the chord for which the variety pattern is to be replaced.

Figures 10A, 10B, 10C, 10D:
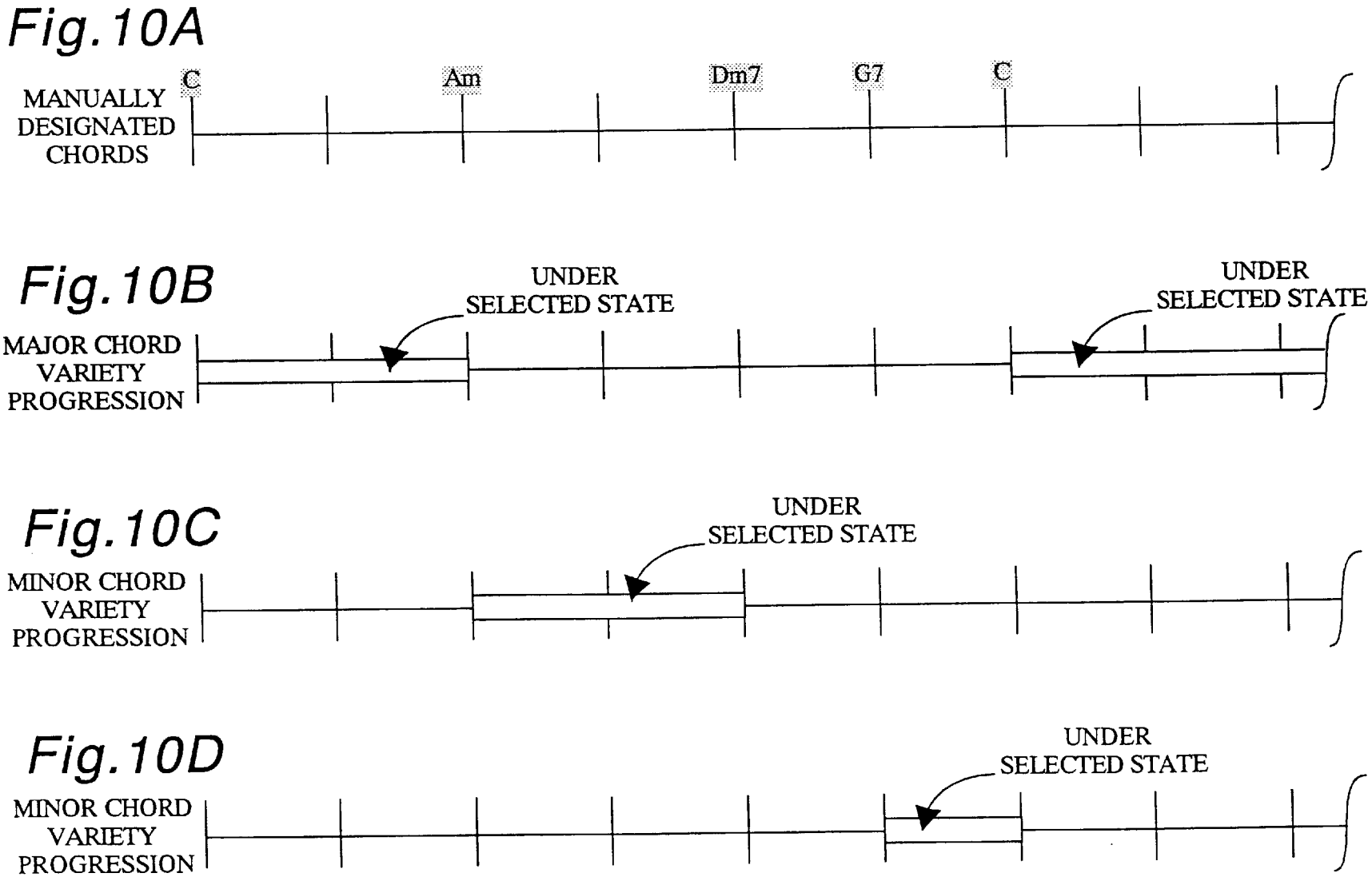
FIGS. 10A–10F are time charts illustrating how the chord progression is varied during an automatic accompaniment performance in the first embodiment of the invention.
Figure 10E:
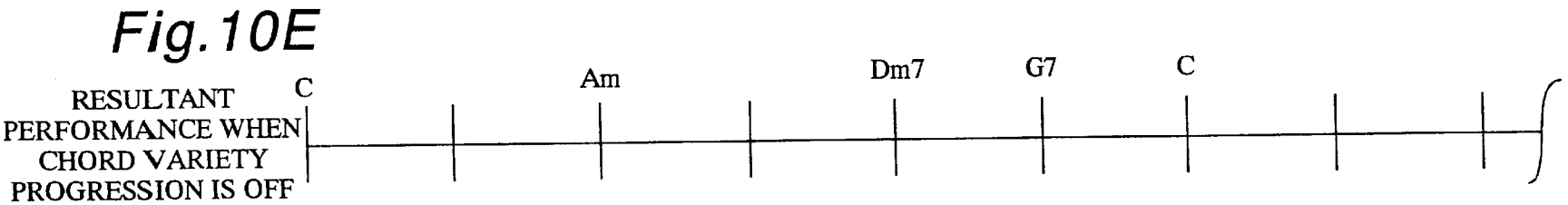
Figure 10F:
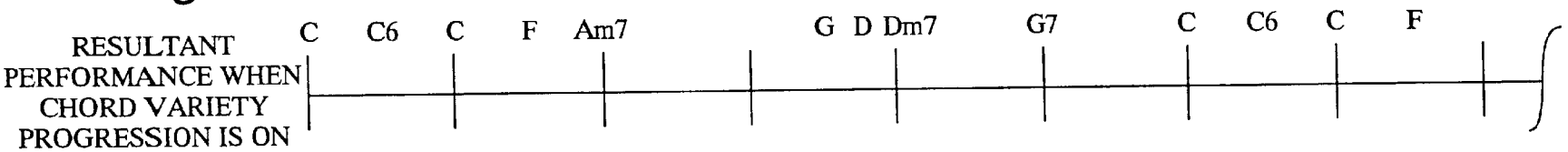

FIGS. 10–10F OF are to illustrate an example of how the chord variety progression patterns will be introduced in the automatic accompaniment performance. Let us assume, for example, the player inputs the chords by playing on the keyboard as shown in FIG. 10A, the progression being chord C major for two measures, chord A minor for two measures, chord D minor seventh for one measure, chord G seventh for one measure, chord C major for two measures, and so forth. Then the respective chord variety progression patterns will be utilized under selected state as shown in FIGS. 10B–10D, respectively. Namely, for the designated chord C major, the major chord variety progression pattern is assigned. For the designated chord A minor, the minor chord variety progression pattern is assigned. And for the designated chord G seventh, the seventh chord variety progression pattern is assigned. But for the designated chord D minor seventh, there is no chord progression pattern prepared. And consequently, when the chord variety progression function is set "off", the resultant automatic accompaniment performance will be such as shown in FIG. 10E, which is quite the same as the manual designation. When the chord variety progression function is set "on", the resultant automatic accompaniment performance will be such as shown in FIG. 10F, which is remarkably modified from the original manual designation.

Further specifically detailed description about how the chord variety progression patterns are introduced is as follows. To begin with, in the first and second measures, the chord which is manually designated on the keyboard is C major, and therefore it is replaced by the major chord variety progression pattern as shown in FIG. 9A with no root note shift. Thus the introduced chord subprogression is C→C6→C→F, each for the length of a half measure. In the third and fourth measures, the chord which is manually designated on the keyboard is A minor, and therefor it is replaced by the minor chord variety progression pattern as shown in FIG. 9B with a root note shift to "A". Thus the introduced chord subprogression is Am7→G→D, respectively for the lengths of one and a half measures, a quarter measure and a quarter measure. In the fifth measure, the chord which is manually designated on the keyboard is D minor seventh, and there is no chord variety progression pattern prepared for the minor seventh chord, and therefore the designated chord itself is performed for the automatic accompaniment. In the sixth measure, the chord which is designated on the keyboard is G seventh, and therefore it is replaced by the seventh chord variety progression pattern as shown in FIG. 9C with a root note shift to "G". Thus the introduced chord subprogression is G seventh for the length of one measure only, with the rest of the variety progression pattern truncated. In the seventh and eight measures, the designated chord is C major as in the above-described first and second measures, and therefore the same chord subprogression of C→C6→C→F is introduced as mentioned above. As may be understood by those skilled in the art, the player's designation of a simple chord progression with slow changes will result in complex chord progression, exhibiting a wide variety in accompaniment performance.

Figure 11:
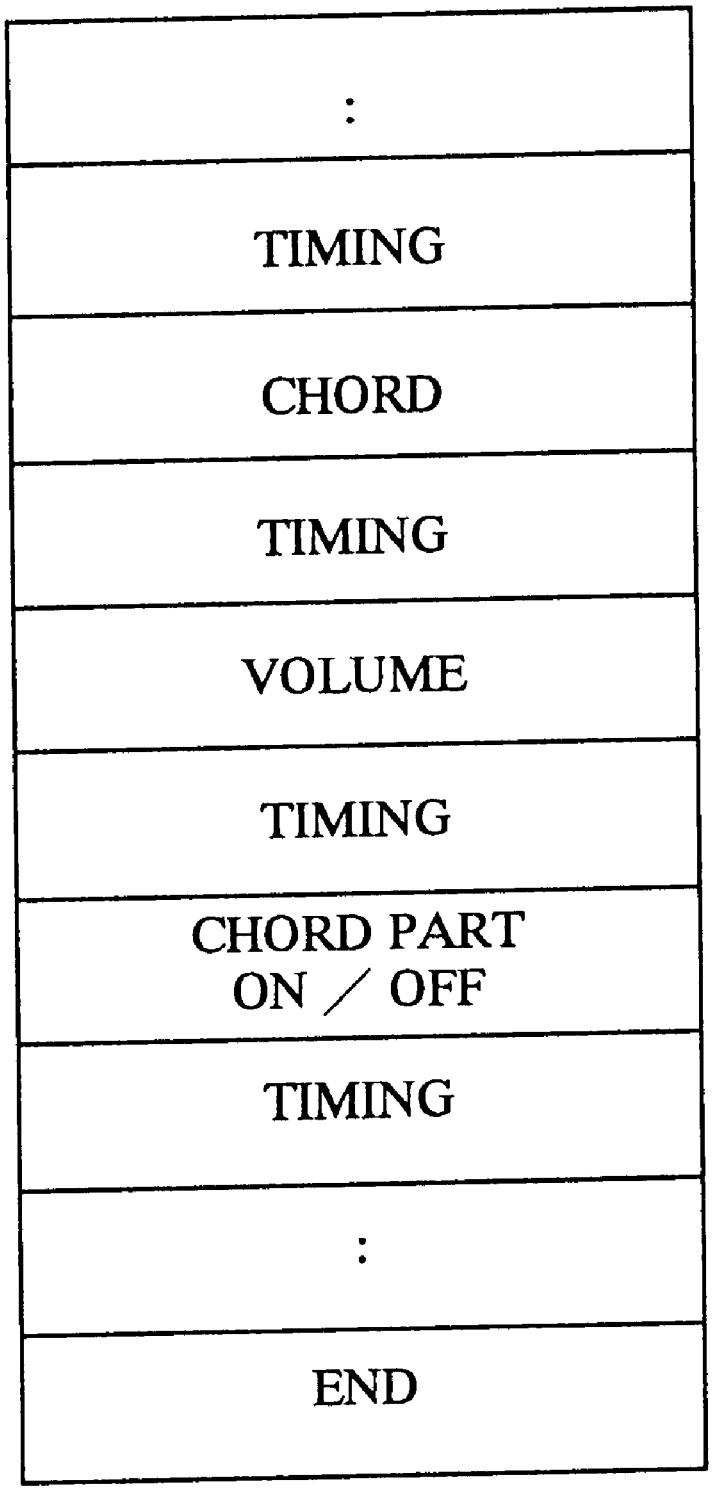
FIG. 11 is a data format chart of an example of a chord variety progression pattern for an automatic accompaniment in a second embodiment of the invention.

While the above example imparts a wide variety in chord progression of automatic accompaniment by merely introducing a subprogression of chords in place of a given chord, further variety can be imparted by the following second example. FIG. 11 shows an example of a data format of a chord variety progression to be employed in the second example. This format includes, in addition to the chord data, a volume data for controlling the volume of the tones to be produced (sounded) and a part on/off data for controlling "on" or "off" of each part in the accompaniment pattern, each preceded by its timing data. When the volume data is read out during the readout of the stored chord variety progression pattern, the volume of the accompaniment tones will be controlled accordingly. In case the part-off data is read out, the tones of that part will be ceased sounding, and when the part-on data is read out next, the tones of that part will be resumed sounding.

Figure 12A:
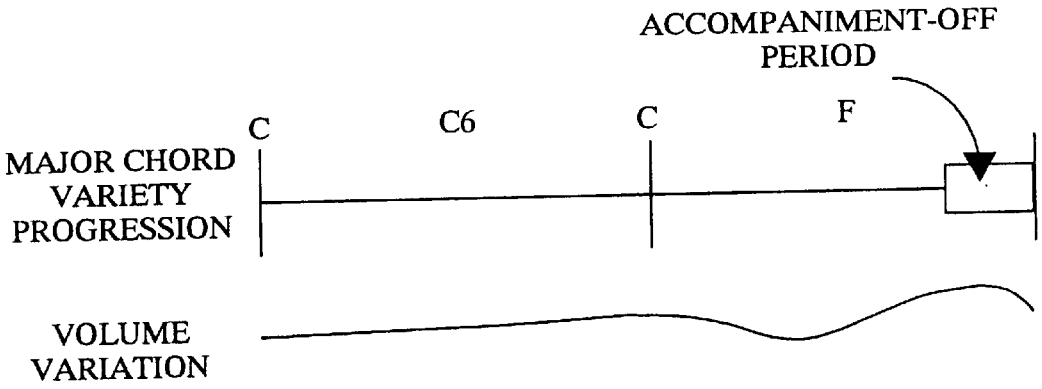
FIGS. 12A–12C are time charts illustrating examples of the chord variety progression patterns in the second embodiment of the invention.
Figure 12B:
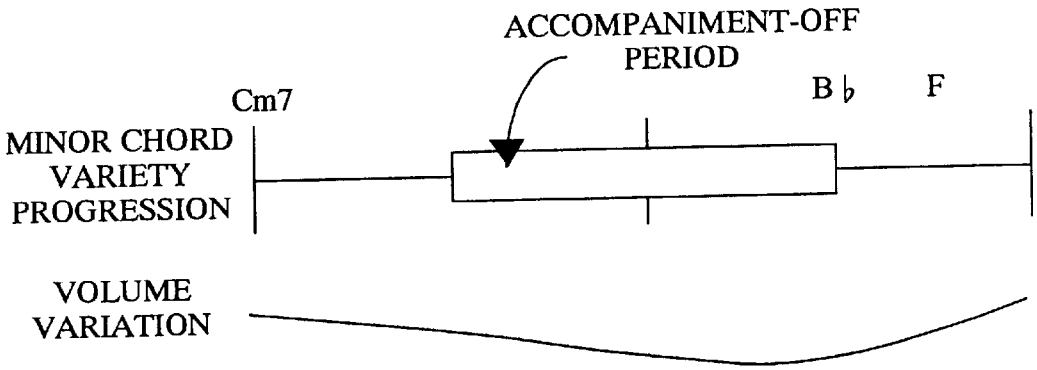
Figure 12C:
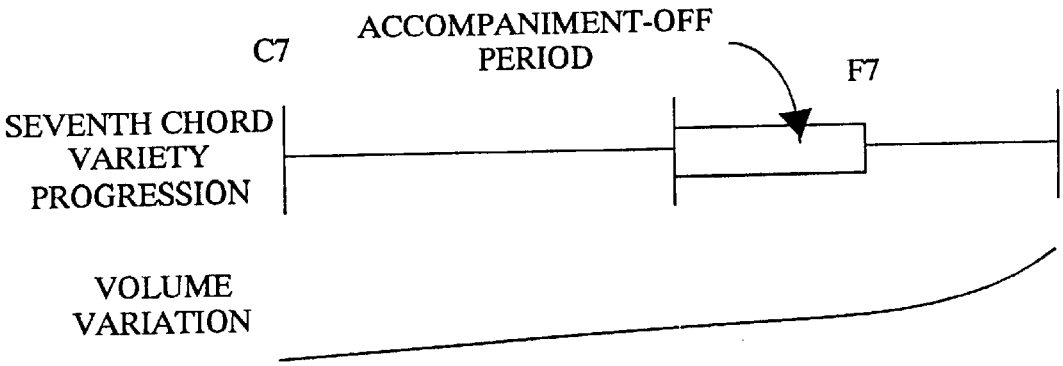

FIGS. 12A–12C are to illustrate examples of chord variety progression patterns with the volume control and the accompaniment on/off control according to the second embodiment of this invention for visual understanding. Each pattern is constructed by two measures (vertical lines represent bar lines) in these examples. FIG. 12A shows a chord variety progression pattern for a major chord having the same chord subprogression pattern as FIG. 9A together with additional control data for volume control and accompaniment part on/off control as indicated in the figure. The volume is to be controlled up and down according to the wave-like curve depicted under the measures. Namely, the volume will started to be increased a bit at the middle of the first measure, and will be once decreased at the middle of the second measure and will thereafter be increased gradually to finally approach the end of the second measure decreasing. This progression pattern further includes a period in which a predetermined accompaniment part is to be cancelled at the final (fourth) quarter of the second measure. FIG. 12B shows a chord variety progression pattern for a minor chord having the same chord subprogression pattern as FIG. 9B together with additional control data for volume control and accompaniment part on/off control as indicated in the figure. The volume is to be gradually decreased toward the first half of the second measure and thereafter be gradually increased toward the end of the second measure. During the period from the second half of the first measure up to the first half of the second measure, a predetermined accompaniment part is to be cut off. FIG. 9C shows a chord variety progression pattern for a seventh chord having the same chord subprogression pattern as FIG. 9C together with additional control data for volume control and accompaniment part on/off control as indicated in the figure. The volume is to be gradually increased from the beginning of the first measure toward the end of the second measure. During the period of the first half of the second measure, a predetermined accompaniment part is to be eliminated. As explained above, the addition of the volume control and the accompaniment part on/off control will enhance the variety of the accompaniment progression. Both of these controls may be commonly applied to all of the accompaniment parts, or alternatively may be applied selectively and independently to the respective accompaniment parts.

In the above described embodiments, the designated chords are detected based on the depression of the keys in the chord key region demarcated from the rest in the keyboard, but the keyboard need not be thus partitioned and the chord detection may be conducted by judging the key depression state throughout the whole keyboard. While the above embodiments are equipped with two chord designation modes, i.e. the single finger mode and the fingered chord mode to be nominated selectively, the provision of only the single finger mode or only the fingered chord mode, or still another mode may suffice as a practical purpose. The invention can be practiced in a system in which the key depression information is inputted from an external apparatus to the automatic accompaniment apparatus of this invention for detecting the chords therein, or in a system in which the detected chord data will be inputted from an external apparatus for conducting the automatic accompaniment performance.

Although the above described embodiments are provided with the chord variety progression patterns for the major, minor and seventh chords, the chord types for which a chord variety progression pattern should be provided may not be limited to these three, but may be more or may be less.

While the above described embodiments are provided with the chord variety progression pattern separately for each accompaniment style, for each accompaniment section, and for each performance part, the chord variety progression patterns may be provided in common to all of the accompaniment styles, sections and performance parts. Alternatively, a plurality of chord variety progression patterns may be provided for each style, each section and each part, such that the user can select one according to his/her preference. Or further, a plurality of chord variety progression patterns may be provided independently from the style and section to be ready for the user's selection. If such selection would be made automatically according to the key touches (depression speed or strength), switch manipulation for the selection would be dispensed with and the chord variety progression patterns would be varied according to the emotional degree of the performance automatically, which will realize a very natural performance. Further, the employment of the chord variety progression patterns may be determined separately for each performance part.

While the above described embodiments employ a manner of storing the chord variety progression patterns in a format of the timing and the chord data for each event, the storage device may contain a unique chord memory area for every predetermined musical progression span (e.g. one beat length) such that chord data shall be written in the spans where the chord change is intended. While the described chord data includes "a root note plus a chord type, and with a non-root note bass, if necessary", the chord data may include "only a chord type, and a non-root note bass, in case of necessity". But in the last case, it is not possible to realize a chord progression in which the chord root notes will vary, but variation in types of the chords will provide an accompaniment with fairly abundant variation to a certain extent. The non-root note bass function may be omitted.

While the accompaniment pattern data and the chord variety progression data are supplied as a combined set of accompaniment style data in the above embodiments, those may be stored in separate files. The system may be so designed that the selection of an accompaniment pattern will cause an automatic search of the corresponding chord variety progression pattern to select one. The chord variety progression pattern may be designed editable, such that the user can modify and store according to his/her preference.

This invention can also be realized in a stringed musical instrument configuration, being not limited to the above-mentioned keyboard type. The invention is not limited to an electronic musical instrument type incorporating a tone generator circuit and an automatic accompaniment function, but may be applied to a system constituted by separate apparatuses for a tone generator, a sequencer, etc. and may be inter-connected using some communication network like MIDI or else.

The above explained configuration of an electronic musical instrument may be replaced by a personal computer plus application software. The application software may be stored in a storage medium like a magnetic disk, a optical disk and a semiconductor memory and then be supplied to a personal computer directly or via a communication network.

The accompaniment data format is "an event plus a relative time" which represents the time of a performance event occurrence by the time span counted from the preceding event in the above embodiments, but the data form may be otherwise, such as "an event plus an absolute time" which represents the time of a performance event occurrence by the absolute time counted, for example, from the beginning of the given music or the beginning of the measure, or "a note pitch (or rest) plus its duration" which represents a performance data by the pitch and the duration of the notes and the duration of the rests, or "a direct memory mapping" which provides memory locations each corresponding to each of the minimum resolution of the music progress and every performance event is written in the memory location corresponding to the timing of the event occurrence. Any other manners prevailing in the computer field may also be used.

The tempo of the automatic accompaniment performance may be varied by changing the period of the tempo clock (for interruption), or modifying the values of the respective timing data according to the tempo still keeping the tempo clock, or changing the decrement or increment value of counting the timing data. Any other manners prevailing in the computer field may be available.

The data of accompaniment patterns may be of a configuration in which the data for a plurality of channels reside in a mixed state, or a configuration in which the data for a plurality of channels are separated into data tracks.

The configuration of the tone generator may be of a waveshape memory type, an FM synthesis type, a physical model type, a partial tone synthesis type, a formant synthesis type, an analog synthesizer type of "VCO+VCF+VCA", or else. Further in place of a unique hardware for tone generation, the tone generator may be constituted by a DSP and a microprogram, or by a CPU and a software program. Further as conventional in the art, the tone generator may be of a time-division-multiplexed type providing a plurality of time-divided channels of a single circuitry for a plurality of simultaneous tone generation, or of an individual circuitry type including an independent circuit for constituting each of the tone generation channels.

The control program may not necessarily be stored in the ROM, but may be stored in a hard disk and be transferred to the RAM at every use to realize same operation by the function of the CPU. This latter manner will be advantageous in the point that the addition or the version-up of the control program will be easily made. The control program and the accompaniment data stored in a CD-ROM may be transferred to the hard disk. This will facilitate a new installment or a version-up maintenance of the control program. Other than a CD-ROM, the external storage may be a floppy disk, an optical magnetic disk, or any other type of media.

A communication interface may be introduced to down load the automatic accompaniment control program, accompaniment pattern data and chord variety progression pattern data from some external database. The apparatus may be connected to a communication network such as a LAN, the Internet, or a telephone communication line to receive the intended data from a server computer via the network and down load into the hard disk.

According to the present invention, the automatic accompaniment apparatus and method, and the automatic accompaniment control program on machine readable media will provide chord variety progression patterns corresponding at least to the types of chords and realize an automatic accompaniment performance employing such chord variety progression patterns corresponding to the types of the designated chords and substituting the designated still chord, to thereby present an automatic accompaniment performance having a wide variety of chord progressions upon designation of simple chord progressions.

While several forms of the invention have been shown and described, other forms will be apparent to those skilled in the art without departing from the spirit of the invention. Therefore, it will be understood that the embodiments shown in the drawings and described above are merely for illustrative purposes, and are not intended to limit the scope of the invention, which is defined by the appended claims.

What is claimed is:

1. An automatic accompaniment apparatus comprising:

chord progression pattern storing means for storing a plurality of sets of chord progression patterns which are provided corresponding at least to the types of chords, chord designating means for designating chords by an operator, chord detecting means for detecting said chords designated by the operator, each chord having a type and a root note, chord progression pattern selecting means for selecting a chord progression pattern which corresponds to the type of said detected chord, and accompaniment performing means for automatically performing an accompaniment for given music by presenting chords in a progression based on said selected chord progression pattern.

2. An automatic accompaniment apparatus as claimed in claim 1, wherein said chord progression pattern is comprised of chords including a fundamental chord and at least another chord, all of said chords being normalized on a predetermined root note with reference to said fundamental chord, and said accompaniment performing means presents chords to perform an accompaniment by shifting the normalized chords constituting said selected chord progression pattern based on the difference between the root note of said detected chord and the root note of said fundamental chord.

3. An automatic accompaniment apparatus as claimed in claim 1, further comprising:

accompaniment pattern storing means for storing a plurality of automatic accompaniment patterns, and accompaniment pattern selecting means for selecting an automatic accompaniment pattern to be performed as an accompaniment to given music from among said plurality of automatic accompaniment patterns, and wherein said chord progression pattern storing means stores said plurality of sets of chord progression patterns for each one of said automatic accompaniment patterns, and said chord progression pattern selecting means selects a chord progression pattern from among said plurality of sets of chord progression patterns prepared for said selected automatic accompaniment pattern.

4. An automatic accompaniment apparatus as claimed in claim 1, wherein said accompaniment performing means performs an automatic accompaniment based on the type of said detected chord without introducing said selected chord progression pattern, in case the type of said detected chord is different from the type of any of the chords for which the chord progression patterns are stored in said chord progression pattern storing means.

5. An automatic accompaniment apparatus as claimed in claim 1, further comprising:

chord progression pattern readout means for reading out a plurality of sets of chord progression patterns in parallel from said chord progression pattern storing means, and wherein said chord progression pattern selecting means selects a set of chord progression pattern which corresponds to the type of the detected chord from among said plurality of sets of chord progression patterns read out in parallel.

6. A machine readable medium for use in an automatic accompaniment apparatus of a data processing type comprising a computer and chord designating means for designating chords by an operator, said medium containing program instructions executable by said computer for causing the automatic accompaniment apparatus to perform the steps of:

providing a plurality of sets of chord progression patterns corresponding at least to the types of chords, detecting the chords designated by the operator, each chord being identified by a type and a root note, selecting a chord progression pattern which corresponds to the type of said detected chord from among said plurality of sets of chord progression patterns, and automatically performing an accompaniment for given music by presenting chords in a progression based on said selected chord progression pattern.

7. A machine readable medium as claimed in claim 6, wherein said chord progression pattern is comprised of chords including a fundamental chord and at least another chord, all of said chords being normalized on a predetermined root note with reference to said fundamental chord, said step of automatically performing an accompaniment presents chords to perform an accompaniment by shifting the normalized chords constituting said selected chord progression pattern based on the difference between the root note of said detected chord and the root note of said fundamental chord.

8. A machine readable medium as claimed in claim 6, further containing program instructions executable by said computer for causing the automatic accompaniment apparatus to perform the steps of:

providing a plurality of automatic accompaniment patterns, and selecting an automatic accompaniment pattern to be performed as an accompaniment to given music from among said plurality of automatic accompaniment patterns, and wherein said step of providing a plurality of sets of chord progression patterns is to provide said plurality of sets of chord progression patterns for each one of said automatic accompaniment patterns, and said step of selecting a chord progression pattern is to select a chord progression pattern from among said plurality of sets of chord progression patterns provided for said selected automatic accompaniment pattern.

9. A machine readable medium as claimed in claim 6, wherein said step of automatically performing an accompaniment is to perform an automatic accompaniment based on the type of said detected chord without introducing said selected chord progression pattern, in case the type of said detected chord is different from the type of any of the chords for which the chord progression patterns are provided by said step of providing a plurality of sets of chord progression patterns.

10. A machine readable medium as claimed in claim 6, further containing program instructions executable by said computer for causing the automatic accompaniment apparatus to perform the step of:

reading out a plurality of sets of chord progression patterns in parallel, and wherein said step of selecting a chord progression pattern is to select a set of chord progression pattern which corresponds to the type of the detected chord from among said plurality of sets of chord progression patterns read out in parallel.

11. An automatic accompaniment apparatus comprising:

a memory that stores a plurality of sets of chord progression patterns which are provided corresponding at least to types of chords, a chord designator designating chords in accordance with an operator's control, a chord detector detecting said chords designated by the operator, each chord having a type and a root note, a chord progression pattern selector selecting a chord progression pattern which corresponds to the type of said detected chord, and an accompaniment performer automatically performing an accompaniment for given music by presenting chords in a progression based on said selected chord progression pattern.

12. A method for performing an automatic accompaniment, comprising the steps of:

designating chords in accordance with the control by an operator, providing a plurality of sets of chord progression patterns corresponding at least to types of chords, detecting the chords designated by the operator, each chord being identified by a type and a root note, selecting a chord progression pattern which corresponds to the type of said detected chord from among said plurality of sets of chord progression patterns, and automatically performing an accompaniment for given music by presenting chords in a progression based on said selected chord progression pattern.

* * * * *